US007605675B2

(12) United States Patent
Bar et al.

(10) Patent No.: US 7,605,675 B2
(45) Date of Patent: Oct. 20, 2009

(54) ELECTROMECHANICAL SWITCH WITH PARTIALLY RIGIDIFIED ELECTRODE

(75) Inventors: Hanan Bar, Jerusalem (IL); Tsung-Kuan Allen Chou, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 443 days.

(21) Appl. No.: 11/472,018

(22) Filed: Jun. 20, 2006

(65) Prior Publication Data

US 2007/0290773 A1 Dec. 20, 2007

(51) Int. Cl.
*H01P 1/15* (2006.01)

(52) U.S. Cl. ..... 333/105; 333/262; 257/415

(58) Field of Classification Search ..... 333/262, 333/105

See application file for complete search history.

(56) References Cited

U.S. PATENT DOCUMENTS 5,258,591 A * 11/1993 Buck ..... 200/181
5,355,524 A * 10/1994 Higgins, Jr. ..... 455/82
6,150,901 A * 11/2000 Auken ..... 333/174
6,307,169 B1 * 10/2001 Sun et al. ..... 200/181
6,426,687 B1 7/2002 Osborn
6,495,387 B2 12/2002 French
6,657,525 B1 12/2003 Dickens et al.
6,686,820 B1 2/2004 Ma et al.
6,744,335 B2 6/2004 Ryhanen et al.
6,812,810 B2 11/2004 Ma et al.
6,812,814 B2 11/2004 Ma et al.
6,875,936 B1 4/2005 Suzuki et al.
6,876,482 B2 4/2005 DeReus
6,880,235 B2 * 4/2005 Ma ..... 29/622
7,042,308 B2 5/2006 Chou
7,101,724 B2 * 9/2006 Chou ..... 438/48
7,170,155 B2 1/2007 Heck et al.
7,171,235 B2 1/2007 Haapoja
7,214,995 B2 5/2007 Chou et al.
7,283,024 B2 10/2007 Bar et al.

(Continued)

FOREIGN PATENT DOCUMENTS

GB 2 353 410 A 2/2001

(Continued)

OTHER PUBLICATIONS

Shen, Shyh-Chiang et al., "Low Actuation Voltage RF MEMS Switches With Signal Frequencies From 0.25GHz to 40GHz," IEDM Technical Digest, 1999, pp. 689-692.

(Continued)

*Primary Examiner*—Benny Lee
*Assistant Examiner*—Alan Wong
(74) *Attorney, Agent, or Firm*—Blakely, Sokoloff, Taylor & Zafman LLP

(57) ABSTRACT

An electromechanical switch with a rigidified electrode includes an actuation electrode, a suspended electrode, a contact, and a signal line. The actuation electrode is disposed on a substrate. The suspended electrode is suspended proximate to the actuation electrode and includes a rigidification structure. The contact is mounted to the suspended electrode. The signal line is positioned proximate to the suspended electrode to form a closed circuit with the contact when an actuation voltage is applied between the actuation electrode and the suspended electrode.

14 Claims, 9 Drawing Sheets

U.S. PATENT DOCUMENTS

| | | | |
|---|---|---|---|
| 7,297,571 | B2 | 11/2007 | Ziaei et al. |
| 7,321,275 | B2 | 1/2008 | Chou et al. |
| 7,362,199 | B2 | 4/2008 | Chou et al. |
| 2002/0190267 | A1 | 12/2002 | Robertson |
| 2003/0020173 | A1 | 1/2003 | Huff et al. |
| 2003/0058069 | A1 | 3/2003 | Schwartz et al. |
| 2003/0201852 | A1 | 10/2003 | Eliacin et al. |
| 2004/0000696 | A1 | 1/2004 | Ma et al. |
| 2004/0050675 | A1 | 3/2004 | Feng et al. |
| 2004/0183148 | A1 | 9/2004 | Blasko, III |
| 2005/0007219 | A1 | 1/2005 | Ma et al. |
| 2005/0134413 | A1 | 6/2005 | Bar et al. |
| 2005/0219016 | A1 | 10/2005 | Chou et al. |
| 2005/0236260 | A1 | 10/2005 | Pasch et al. |
| 2005/0248424 | A1 | 11/2005 | Chou et al. |
| 2005/0285697 | A1 | 12/2005 | Chou et al. |
| 2006/0065942 | A1 | 3/2006 | Chou et al. |
| 2006/0226501 | A1 | 10/2006 | Chou |
| 2006/0289954 | A1 | 12/2006 | Bar-Sadeh et al. |

FOREIGN PATENT DOCUMENTS

| | | | |
|---|---|---|---|
| WO | WO 97/18574 | | 5/1997 |
| WO | WO 99/17322 | | 4/1999 |
| WO | WO 2005/023699 | A1 | 3/2005 |
| WO | WO 2005/104158 | A1 | 11/2005 |

OTHER PUBLICATIONS

Pacheco, Sergio P. et al., "Design of Low Actuation Voltage RF MEMS Switch," IEEE MTT-S Digest, 2000, pp. 165-168.
Park, Jae et al., "Electroplated RF MEMS Capacitive Switches," The Thirteenth Annual International Conference on MEMS 2000, Jan. 23-27, 2000, pp. 639-644.
U.S. Appl. No. 11/092,022, filed May 13, 2005.
U.S. Appl. No. 11/165,795, filed Jun. 23, 2005.
U.S. Appl. No. 11/168,195, filed Jul. 1, 2005.
U.S. Appl. No. 11/317,960, filed Dec. 22, 2005.
U.S. Appl. No. 11/435,259, filed May 16, 2006.
Nishijima, N. et al., "A Low-Voltage High Contact Force RF-MEMS Switch," IEEE MTT-S Digest (2004), pp. 577-580.
International Search Report for PCT/US2006/046894 (WO2007/078589), filed Dec. 7, 2006, Report mailed May 14, 2007, (3 pages).
Written Opinion of the International Search Authority for PCT/US2006/046894 (WO2007/078589), filed Dec. 7, 2006, Opinion mailed May 14, 2007 (5 pages).
International Search Report for PCT/US2006/024724 (WO2007/002549), filed Jun. 23, 2006, Report mailed Nov. 2, 2006 (5 pages).
Written Opinion of the International Search Authority for PCT/US2006/024724 (WO2007/002549), filed Jun. 23, 2006, Opinion mailed Dec. 23, 2007, (8 pages).

* cited by examiner

ELECTROMECHANICAL SWITCH WITH PARTIALLY RIGIDIFIED ELECTRODE

TECHNICAL FIELD

This disclosure relates generally to electromechanical switches, and in particular, relates to micro-electromechanical systems ("MEMS") switches.

BACKGROUND INFORMATION

Micro-electromechanical systems ("MEMS") devices have a wide variety of applications and are prevalent in commercial products. One type of MEMS device is a MEMS radio frequency (RF) switch. A typical MEMS RF switch includes one or more MEMS switches arranged in an RF switch array. MEMS metal-to-metal contact RF switches are ideal for wireless devices because of their low power characteristics and ability to operate in radio frequency ranges. MEMS metal-to-metal contact RF switches are well suited for applications including cellular telephones, wireless networks, communication systems, and radar systems. In wireless devices, MEMS RF switches can be used as antenna switches, mode switches, transmit/receive switches, and the like.

Known MEMS switches use an electroplated metal cantilever supported at one end and having an electrical RF metal-to-metal contact near the distal end of the metal cantilever. An actuation electrode is positioned below the electrical RF contact and a direct current ("DC") actuation voltage applied to either the actuation electrode or the metal cantilever forces the metal cantilever to bend downward and make electrical contact with a bottom RF signal trace. Once electrical contact is established, the circuit is closed and an RF signal can pass through the metal cantilever to the actuation electrode and/or to the bottom RF signal trace.

These MEMS switches typically require 40 V or more actuation voltage. If the actuation voltage is reduce much below 40 V, then the spring constant of the cantilever must be reduced. These lower voltage MEMS switches suffer from "stiction" (i.e., stuck in a closed circuit position) and tend to be self-actuated by RF signals or vibrations due to their low spring constants. During fabrication, the electroplated metal cantilever suffers from high stress gradients and therefore has a tendency to curl upwards at the distal end, referred to as switch stress gradient bending. Accordingly, the actuation voltage must be sufficiently large to overcome the larger separation distance due to beam bending and induce electrostatic collapse between the metal cantilever and the actuation electrode below.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Embodiments of an electromechanical switch including a partially rigidified suspended electrode and systems thereof are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1A:
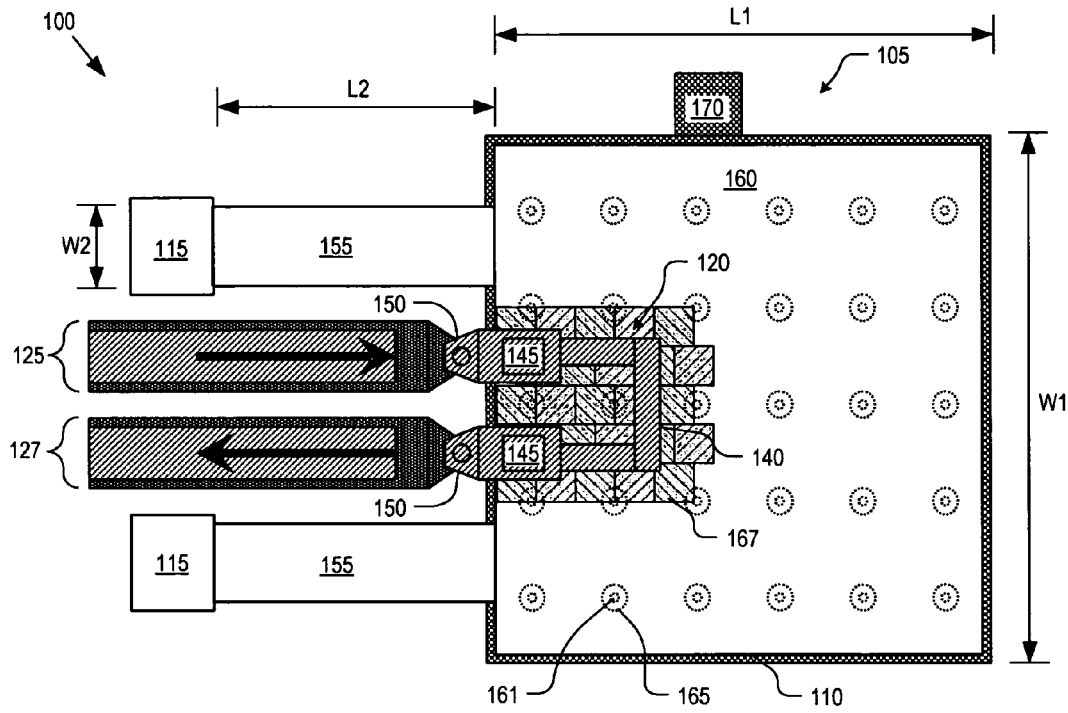
FIG. 1A is a schematic diagram illustrating a plan view of a switch including a suspended electrode having a rigidification topology localized about a contact, in accordance with an embodiment of the invention.
Figure 1B:
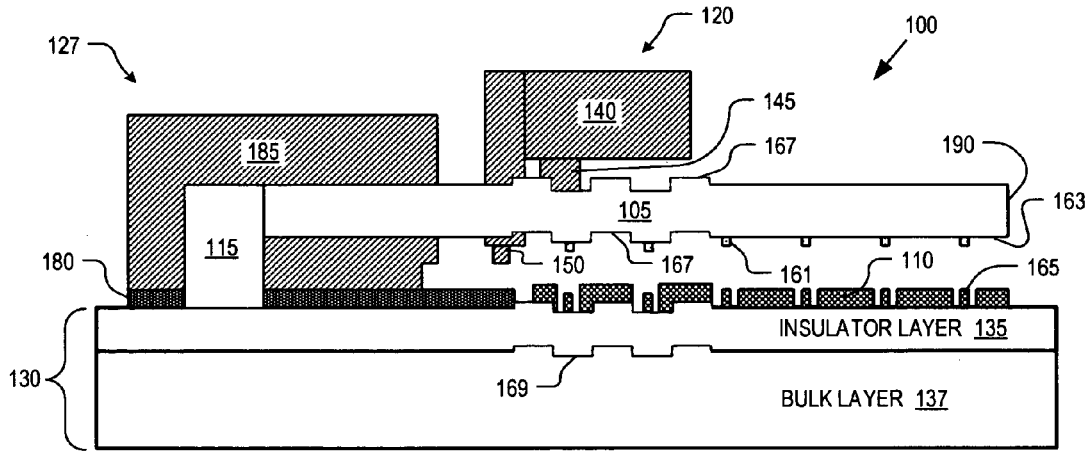
FIG. 1B is a schematic diagram illustrating a cross-sectional view of a switch including a suspended electrode having a rigidification-topology localized about a contact, in accordance with an embodiment of the invention.

FIGS. 1A and 1B are schematic diagrams illustrating a micro-electromechanical ("MEMS") switch 100, in accordance with an embodiment of the invention. FIG. 1A is a plan view of MEMS switch 100 while FIG. 1B is a cross-sectional view of the same. It should be appreciated that the figures herein are not drawn to scale, but rather are merely intended for illustration.

The illustrated embodiment of MEMS switch 100 includes a suspended electrode 105, an actuation electrode 110, anchors 115, a contact 120, an input signal line 125, and an output signal line 127. MEMS switch 100 is mounted on a substrate 130, which includes an insulating layer 135 and a bulk layer 137. The illustrated embodiment of contact 120 includes a suspended trace 140, trace mounts 145, and protruding contacts 150. The illustrated embodiment of suspended electrode 105 includes narrow members 155 and a plate member 160. Plate member 160 further includes stopper stubs 161 formed on an underside 163. Stopper butts 165 are defined within actuation electrode 110, but electrically insulated therefrom and positioned to abut stopper stubs 161 when suspended electrode 105 collapses onto actuation electrode 110. Suspended electrode 105 further includes a rigidification structure 167 to reinforce and rigidify a portion of suspended electrode 105. Actuation electrode 110 includes an input port 170 for applying an actuation voltage between actuation electrode 110 and suspended electrode 105 to electrostatically induce a progressive zipper-like collapse of suspended electrode 105. Signal lines 125 and 127 each include a bottom electrode 180 and an upper layer 185. It should be appreciated that in some cases only one or two instances of a component/element have been labeled so as not to crowd the drawings.

Substrate 130 may be formed using any material including various semiconductor substrates (e.g., silicon substrate). Insulator layer 135 is provided as a dielectric layer to insulate bottom electrode 180 and actuation electrode 110 from each other and from bulk layer 137. If bulk layer 137 is an intrinsic insulator then embodiments of the invention may not include insulator layer 135. Although not illustrated, bulk layer 137 may include a number of sub-layers having signal traces or components (e.g., transistors and the like) integrated therein and electrically coupled to any of signal lines 125 or 127, anchors 115, or actuation electrode 110. In an embodiment where bulk layer 137 includes silicon, insulator layer 135 may include a layer of silicon nitride approximately 0.25 μm thick. The width of signal lines 125 and 127 may be dependent upon the desired impedance to be achieved by a circuit.

In one embodiment, signal lines 125 and 127 are formed on insulator layer 135 to propagate radio frequency ("RF") signals. However, it should be appreciated that embodiments of MEMS switch 100 may be used to switch other frequency signals including direct current ("DC") signals, low frequency signals, microwave signals, and the like. Bottom electrode 180 and upper layer 185 may be formed using any conductive material, including metal, such as gold (Au). In one embodiment, bottom electrode is approximately 20 μm to 60 μm wide and 0.3-0.5 μm thick, while upper layer 185 is approximately 6 μm thick.

Actuation electrode 110 is formed on insulator layer 135 to form a bottom electrode for actuating cantilever electrode 105 and turning on/off MEMS switch 100. Actuation electrode 110 may be formed of any number of conductive materials, including polysilicon. Input port 170 may also be fabricated of polysilicon and is coupled to actuation electrode 110 to switchably apply the actuation voltage thereto. In one embodiment, actuation electrode 110 has a width W1 (e.g., ≈200 μm) and a length L1 (e.g., ≈200 μm) and a thickness of approximately 0.1-0.2 μm. As illustrated, a number of stopper butts 165 are interspersed within actuation electrode 110. In the illustrated embodiment, stopper butts 165 are electrically insulated from actuation electrode 110 by an air gap (e.g., ≈2-3 μm).

As mentioned above, the illustrated embodiment of suspended electrode 105 includes three members: two narrow members 155 and plate member 160. Narrow members 155 are mounted to anchors 115, which in turn mount suspended electrode 105 to substrate 130 over actuation electrode 110. In one embodiment, suspended electrode 105 is fabricated using low stress gradient ("LSG") polysilicon. LSG polysilicon can be processed without severe upward curling of suspended electrode 105. In other words, during fabrication of suspended electrode 105 using a LSG polysilicon material, suspended electrode 105 remains relatively parallel to substrate 130 along its length (e.g., less than 25 nm of bending over 350 μm span of suspended electrode 105) and therefore distal end 190 experiences relatively minor or no upward curling.

Suspended electrode 105 may be fabricated by first defining actuation electrode 110 and anchors 115 on substrate 130, then forming a sacrificial layer (e.g., deposited oxide) over actuation electrode 110 to fill the air gap between suspended electrode 105 and actuation electrode 110. Next, suspended electrode 105 may be formed over the sacrificial layer and anchors 115 and contact 120 formed thereon. Subsequently, the sacrificial layer may be etched away with an acid bath (e.g., hydrofluoric acid) to free the bendable portion of suspended electrode 105.

In one embodiment, rigidification structure 167 is formed within suspended electrode 105 by first patterning 3-dimensional topology 169 into substrate 130 underneath rigidification structure 167. When subsequent layers are disposed over 3-dimensional topology 169 (e.g., insulator layer 135, actuation electrode 110, the sacrificial layer, and suspended electrode 105), the 3-dimensional topology is copied to each successive layer above. By forming 3-dimensional topology 169 in substrate 130 and actuation electrode 110, the separation distance between each portion of suspended electrode 105 (including the portion having rigidification structure 167 disposed therein) and actuation electrode 110 is maintained at a constant. Since actuation is electrostatically induced and the electrostatic collapsing force for a given voltage is inversely proportional to the separation distance, maintaining a constant separation distance between the two electrodes reduces the impact of rigidification structure 167 on the actuation voltage.

In one embodiment, plate member 160 has approximately the same dimensions, length L1 and width W1, as actuation electrode 110 (perhaps slightly smaller in some embodiments though need not be so) and narrow members 155 have a width W2 (e.g., ≈30-60 μm) and a length L2 (e.g., ≈50-150 μm). In one embodiment, suspended electrode 105 is approximately 2-4 μm thick. It should be appreciated that other dimensions may be used for the above components.

Stopper stubs 161 are formed on underside 163 of plate member 160 to prevent suspended electrode 105 from collapsing directly onto actuation electrode 110 and forming an electrical connection thereto. If suspended electrode 105 were to form electrical connection with actuation electrode 110 while MEMS switch 100 is closed circuited, then the actuation voltage between the two electrode would be shorted, and MEMS switch 100 would open. Further, allowing actuation electrode 110 and suspended electrode 105 to short circuit results in needless and harmful power dissipation. Accordingly, stopper stubs 161 are positioned on underside 163 to align with the insulated stopper butts 165 so as to prevent an electrical connection between suspended electrode 105 and actuation electrode 110.

In one embodiment, anchor 115 supports suspended electrode 105 approximately 0.5-2.0 μm above actuation electrode 110. Since polysilicon is a relatively hard substance and due to the multi spring constant nature of suspended electrode 105 (discussed in detail below) and stopping functionality of stopper stubs 161, very small separation distances between suspended electrode 105 and actuation electrode 110 can be achieved (e.g., 0.6 μm or less). Due to the small air gap between suspended electrode 105 and actuation electrode 110 and the low curling properties of LSG polysilicon, an ultra-low actuation voltage (e.g., 3.0V actuation voltage) MEMS switch 100 can be achieved.

The illustrated embodiment of contact 120 includes a suspended trace 140 mounted to suspended electrode 105 via trace mounts 145. Suspended trace 140 may be coupled to dual protruding contacts 150 that extend below suspended electrode 105 to make electrical contact with bottom electrode 180 when MEMS switch 100 is closed circuited. In one embodiment, contact 120 is fabricated of metal, such as gold (Au). In one embodiment, a insulating layer is disposed between trace mounts 145 and suspended electrode 105; however, since trace mounts 145 are relatively small and suspended trace 140 is fabricated of metal being substantially more conductive than suspended electrode 105, the insulating layer may not be included in some embodiments (as illustrated). In one embodiment, suspended trace 140 is approximately 10 μm wide and 6 μm thick.

Contact 120 may be mounted to suspended electrode 105 closer to anchors 115 than to distal end 190. In one embodiment, contact 120 may be positioned between anchors 115 and a center of plate member 160. Positioning contact 120 closer to anchors 115 helps prevent stiction and false switching due to self-actuation or vibrations, as is discussed below.

It should be appreciated that a number of modifications may be made to the structure of MEMS switch 100 illustrated in FIGS. 1A and 1B within the spirit of the present invention. For example, a single anchor 115 and single narrow member 155 may be used to suspend a smaller plate member 160 above actuation electrode 110. In this alternative embodiment, protruding contacts 150 may straddle each side of this single narrow member 155. In yet another embodiment, a single protruding contact 150 may be used to make bridging contact with both signal lines 125 and 127. In yet other embodiments, the specific shapes of suspended electrode 105 and actuation electrode 110, as well as other components, may be altered.

Figure 2A:
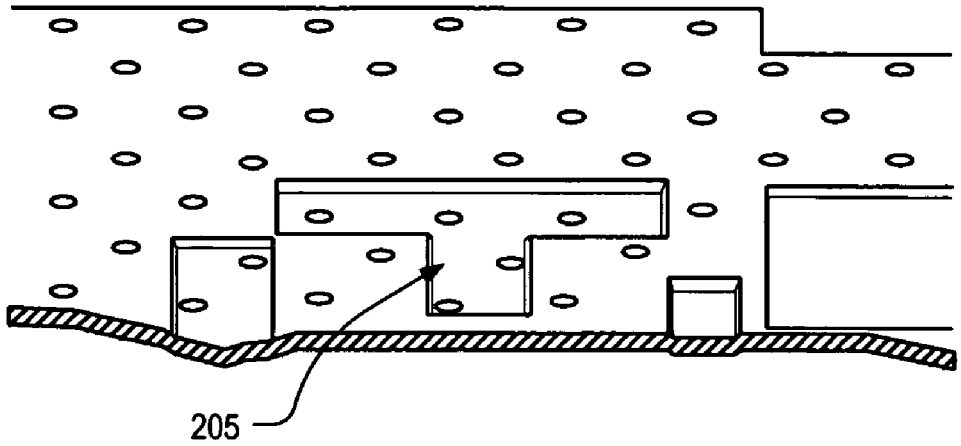
FIG. 2A is an expanded perspective view illustrating a 3-dimensional rigidification structure, in accordance with an embodiment of the invention.
Figure 2B:
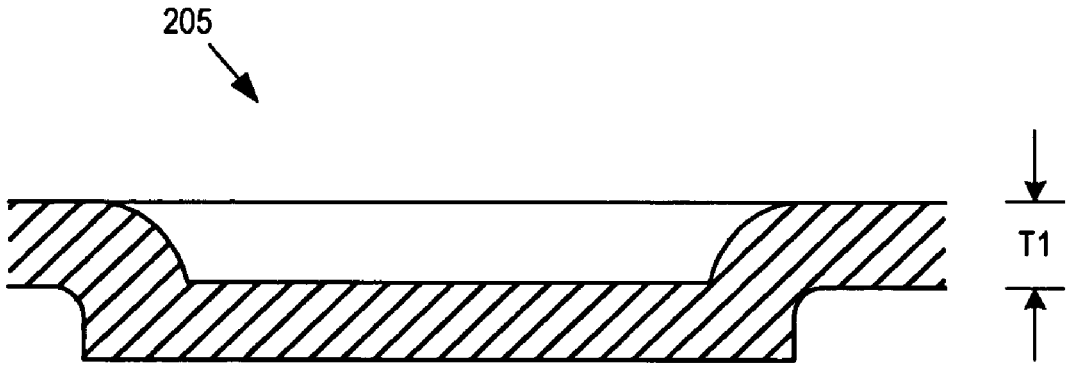
FIG. 2B is an expanded cross-sectional view illustrating a 3-dimensional rigidification topology, in accordance with an embodiment of the invention.

FIGS. 2A and 2B illustrated expanded views of a demonstrative 3-dimensional rigidification topology, in accordance with an embodiment of the invention. FIG. 2A is a perspective view of a portion of rigidification structure 167, while FIG. 2B is a cross-sectional view of the same. FIGS. 2A and 2B are not intended to be limiting, but merely demonstrative of a possible 3-dimensional topology that may be formed into a portion of suspended electrode 105 for localized rigidification.

In the illustrated embodiments, rigidification structure 167 is a 3-dimensional rigidification topology disposed in plate member 160 and localized about contact 120 to increase the stiffness of plate member 160 about contact 120. In one embodiment, rigidification structure 167 may include recesses 205 having an approximate depth T1 of 2μ (micron). By rigidifying the portion of suspended electrode 105 about contact 120, greater force is transferred from suspended electrode 105 onto contact 120 during actuation. As is discussed below in greater detail, greater contact force between protruding contacts 150 and bottom electrodes 180 of signal lines 125 and 127 reduces switch resistance and insertion loss. Furthermore, greater contact force acts to penetrate thin contamination layers that may accumulate or settle between protruding contacts 150 and bottom electrodes 180 and therefore increase the reliability of MEMS switch 100.

Figure 7A:
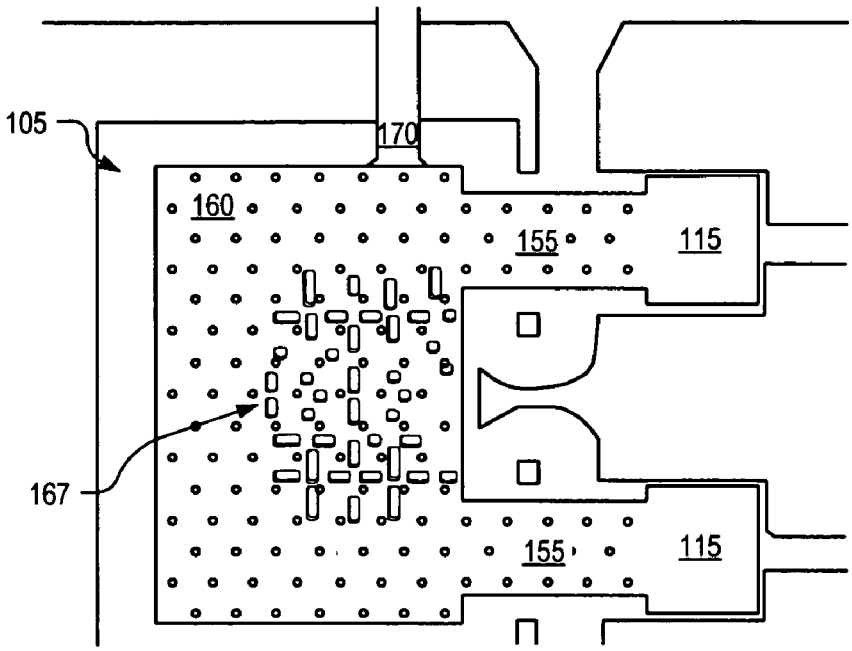
FIG. 7A is a plan view illustrating a circuit layout of a partially fabricated switch including a suspended electrode having a rigidification topology localized about a contact, in accordance with an embodiment of the invention.
Figure 7B:
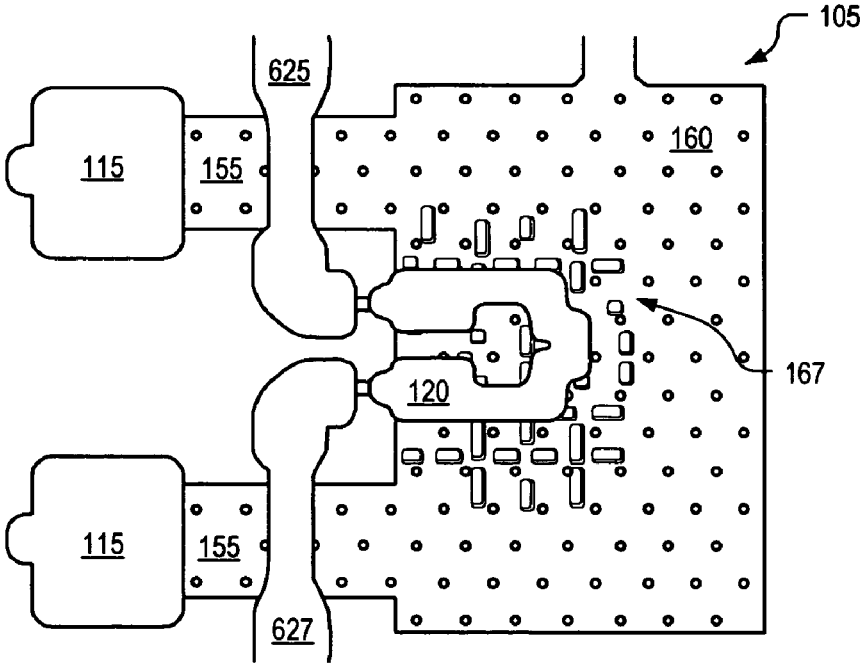
FIG. 7B is a plan view illustrating a circuit layout of a fully fabricated switch including a suspended electrode having a rigidification topology localized about a contact, in accordance with an embodiment of the invention.

Rigidification structure 167 may assume a variety of 3-dimensional topologies for reinforcing plate member 160 about contact 120. For example, 3-dimensional rigidification topologies may include an undulated surface, ridges, elongated mesa structures (e.g., T-shaped structures), recesses, trenches, dimples, bumps, or otherwise. The 3-dimensional rigidification topology may be a regular repeated pattern (e.g., checkerboard pattern as illustrated in FIG. 1A) or an irregular pattern (as illustrated in FIGS. 7A and 7B).

Figure 2C:
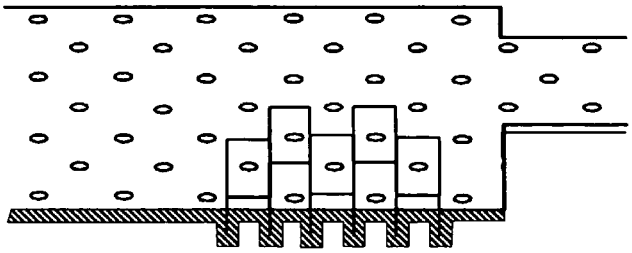
FIG. 2C is an expanded perspective view illustrating a 3-dimensional rigidification structure, in accordance with an embodiment of the invention.
Figure 2D:
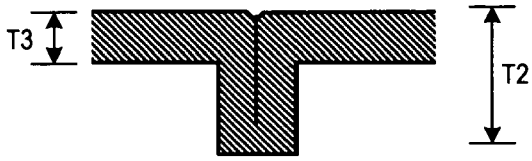
FIG. 2D is an expanded cross-sectional view illustrating a 3-dimensional rigidification topology, in accordance with an embodiment of the invention.
Figure 2E:
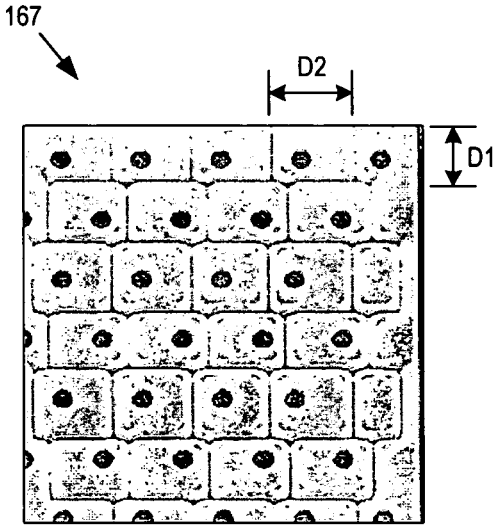
FIG. 2E is a plan view illustrating an expanded section of a 3-dimensional rigidification topology using an scanning electron microscope, in accordance with an embodiment of the invention.
Figure 2F:
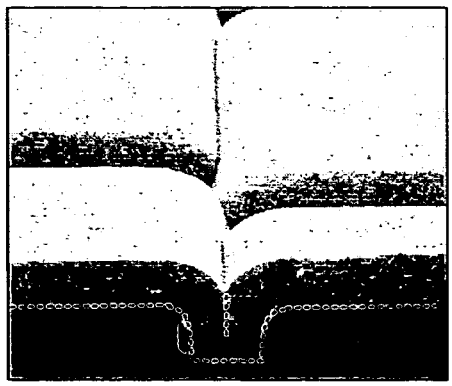
FIG. 2F is an expanded perspective view illustrating a 3-dimensional rigidification structure using a scanning electron microscope, in accordance with an embodiment of the invention.

FIGS. 2C, 2D, 2E, and 2F all illustrate an elongated mesa structure embodiment of rigidification structure 167. FIG. 2C is a perspective view sketch, FIG. 2D is a cross-sectional sketch, FIG. 2E is a plan view using a scanning electron microscope, and FIG. 2F a perspective view using a scanning electron microscope of the same embodiment. The illustrated embodiment includes a checkerboard-like pattern of elongated mesa structures (e.g., T-shaped rigidification structures). In one embodiment, T3≅2 μm, T2≅4 μm to 6 μm, D1≅10 μm to 20 μm, and D2≅10 μm to 20 μm. In one embodiment, the overall surface dimension of the illustrated embodiment of rigidification structure 167 is between 40 μm×40 μm to 100 μm×100 μm. It should be appreciated that these dimensions are only representative, and embodiments of the invention may be smaller or larger and have different relative proportions.

Figure 3:
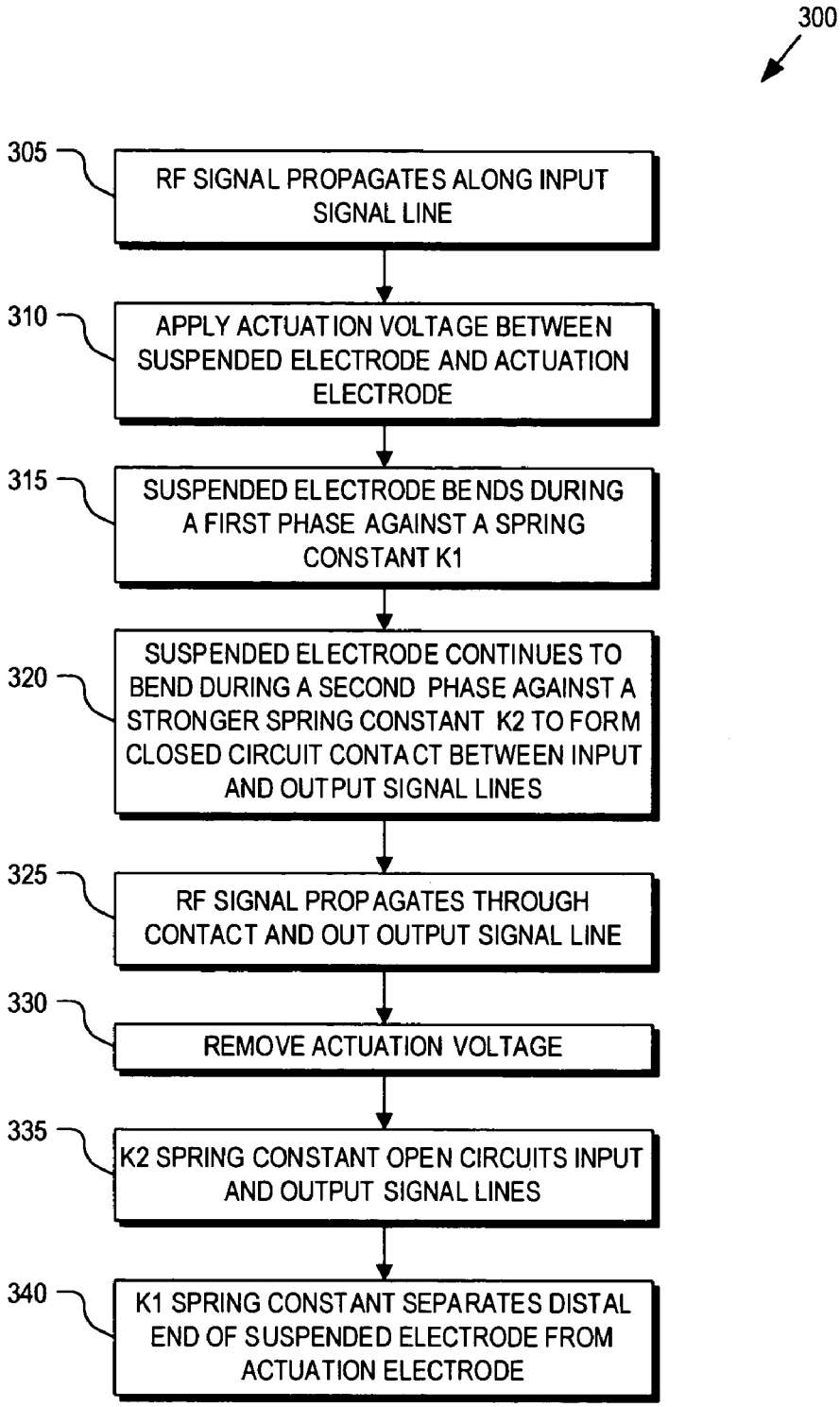
FIG. 3 is a flow chart illustrating a process of operation of a switch including a partially rigidified suspended electrode, in accordance with an embodiment of the invention.

FIG. 3 is a flow chart illustrating a process 300 for operation of MEMS switch 100, in accordance with an embodiment of the invention. It should be appreciated that the order in which some or all of the process blocks appear in process 300 should not be deemed limiting. Rather, one of ordinary skill in the art having the benefit of the present disclosure will understand that some of the process blocks may be executed in a variety of orders not illustrated.

In a process block 305, an RF signal is propagated along input signal line 125. In a process block 310, an actuation voltage is applied between actuation electrode 110 and suspended electrode 105. In one embodiment, suspended electrode 105 is electrically grounded through anchors 115 and the actuation voltage is applied to actuation electrode 110 through input port 170. Alternatively, actuation electrode 110 may be grounded through input port 170 and the actuation voltage applied to suspended electrode 105 through anchors 115.

Figure 5:
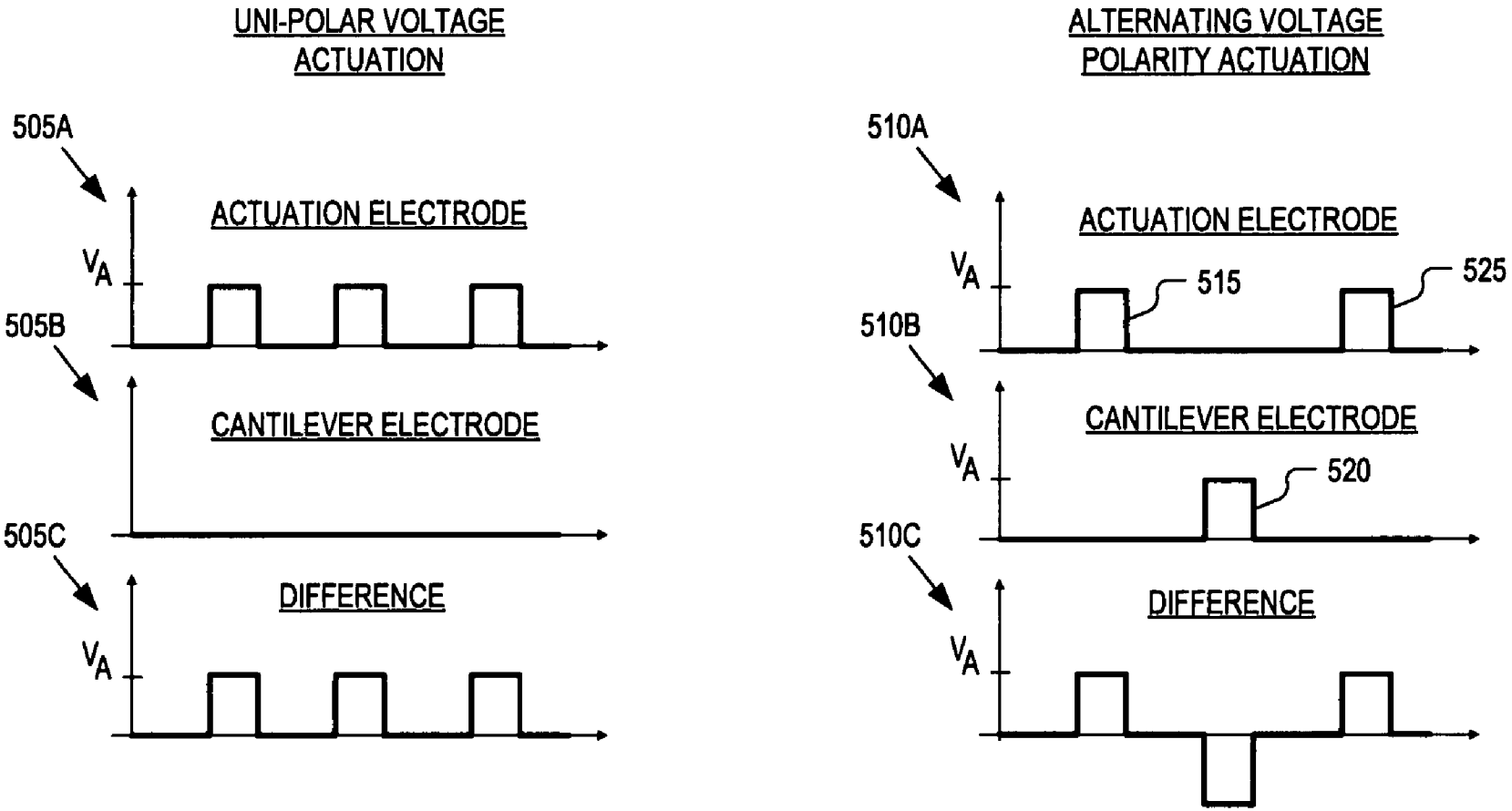
FIG. 5 illustrates line graphs of uni-polar voltage actuation and alternating polarity voltage actuation of a switch including a partially rigidified suspended electrode, in accordance with an embodiment of the invention.

Referring to FIG. 5, either uni-polar voltage actuation (illustrated by line graphs 505A, B, C) or alternating voltage polarity actuation (illustrated by line graphs 510A, B, C) may be applied. Since suspended electrode 105 and actuation electrode 110 are substantially electrically decoupled from the RF signal path (e.g., signal lines 125, 127 and contact 120), the polarity of the voltage actuation may be changed without affecting the RF signal. Line graph 505A illustrates three consecutive uni-polar actuations of MEMS switch 100 wherein the actuation voltage $V_A$ is applied to actuation electrode 110. Line graph 505B illustrates the same three consecutive actuations wherein the voltage of suspended electrode 105 remains grounded. Line graph 505C illustrates the voltage different between actuation electrode 110 and suspended electrode 105.

Line graphs 510A and 510B illustrate three consecutive alternating voltage polarity actuations of MEMS switch 100. A first actuation 515 of MEMS switch 100 is induced by application of actuation voltage $V_A$ to actuation electrode 110 while suspended electrode 105 remains grounded. A second actuation 520 of MEMS switch 100 is induced by application of actuation voltage $V_A$ to suspended electrode 105 while actuation electrode 110 remains grounded. A third actuation 525 repeats the first actuation instance 515. Accordingly, line graph 510C illustrates the potential difference between actuation electrode 110 and suspended electrode 105. Over many cycles, the actuation voltage between the two electrodes will have a net zero DC component. Use of alternating polarity actuations of MEMS switch 100 may be more desirable when higher actuation voltages $V_A$ are used (e.g., >10V).

Figure 4A:
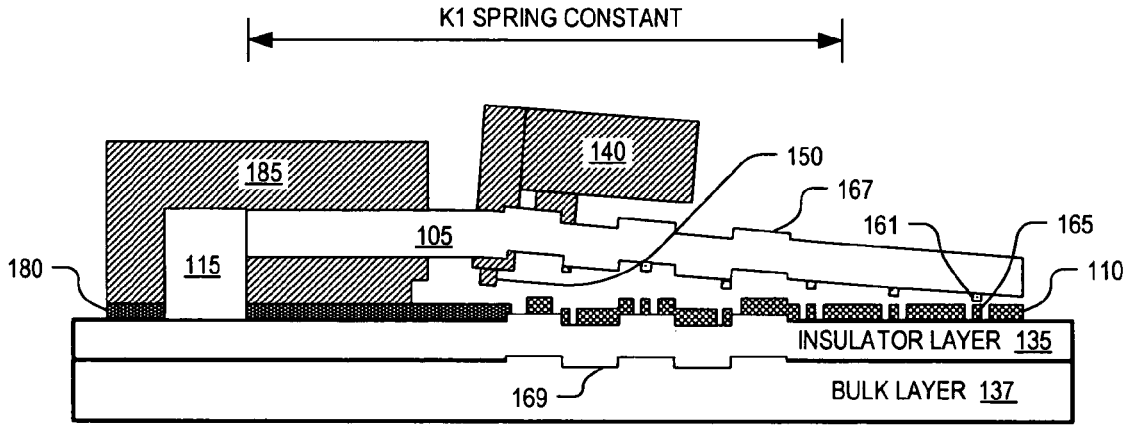
FIG. 4A is a schematic diagram illustrating a first bending phase of a switch including a partially rigidified suspended electrode in an open circuit position, in accordance with an embodiment of the invention.

Returning to process 300, in a process block 315, the application of the actuation voltage across suspended electrode 105 and actuation electrode 110 induces suspended electrode 105 to bend or electrostatically collapse toward actuation electrode 110. This initial bending phase is illustrated in FIG. 4A. As illustrated, the actuation voltage is sufficient to cause distal end 190 of suspended electrode 105 to progressively collapse to a point where the furthest most stopper stub 161 mates with the furthest most stopper butt 165. In this sense, suspended electrode 105 acts like a cantilever electrode having a fixed end mounted to anchors 115 and a free moving end at distal end 190.

The actuation voltage is sufficient to overcome the initial restoring force produced by suspended electrode 105 having a first spring constant K1. The restoring force of suspended electrode 105 is weakest during this initial bending phase due to the mechanical advantage provided by the cantilever lever arm between distal end 190 and anchors 115. It should be noted that during this initial bending phase, protruding contacts 150 have not yet formed a closed circuit between signal lines 125 and 127.

Figure 4B:
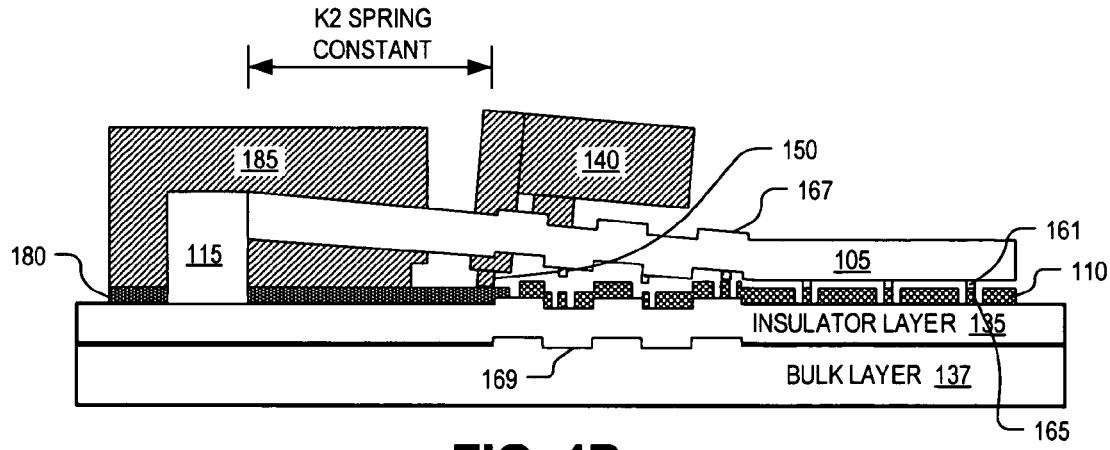
FIG. 4B is a schematic diagram illustrating a second bending phase of a switch including a partially rigidified suspended electrode in a closed circuit position, in accordance with an embodiment of the invention.

In a process block 320, MEMS switch 100 enters a second bending phase illustrated in FIG. 4B. Between the point at which distal end 190 make physical contact with one of stopper butts 165 and MEMS switch 100 becomes closed circuited, the restoring force resisting the electrostatic collapsing force increases proportional to a second larger spring constant K2. It should be understood that suspended electrode 105 may not have only two abrupt spring constants K1 and K2, but rather K1 and K2 represent smallest and largest spring constants, respectively, generated by the cantilever of suspended electrode 105 during the course of one progressive switching cycle. During this second bending phase, suspended electrode 105 begins to collapse inward with a progressive "zipper-like" movement starting at distal end 190 moving towards anchors 115 until protruding electrodes 150 contact bottom electrode 180 forming a closed circuit. As the zipper-like collapsing action continues, the restoring force generated by suspended electrode 105 increases. However, as suspended electrode 105 continues to collapse onto stopper butts 165 the separation distance between the suspended electrode 105 and actuation electrode 110 decreases, resulting in a corresponding drastic increase in the electrostatic collapsing force. This increase in the electrostatic collapsing force is sufficient to overcome the increasingly strong restoring force proportional to the larger spring constant K2 of suspended electrode 105. Accordingly, ultra-low actuation voltages equal to digital logic level voltages (e.g., 3.3V or less) can be reliably achieved with embodiments of the invention.

Since rigidification structure 167 is localized only about contact 120, it does not significantly alter the actuation voltage of MEMS switch 100. However, rigidification structure 167 does act to significantly stiffen suspended electrode 105 about contact 120, and therefore, impart a greater compressive force onto protruding contacts 150 during the second bending phase. It should be noted that the actuation voltage is primarily determined by the first spring constant K1 during the first bending phase. However, since the distal end 190 of suspended electrode 105 primarily flexes during the first bending phase, rigidification structure 167 has a less significant impact on the actuation voltage. Accordingly, while the entire suspended contact 105 can be rigidified to increase contact pressure during actuation, doing so increases the actuation voltage.

Once MEMS switch 100 is closed circuited, the RF signal can propogate through contact 120 and out output signal line 127 (process block 325). To open circuit MEMS switch 100, the actuation voltage is removed (process block 330). Upon removal of the actuation voltage, the electrostatic collapsing force relents, and suspended electrode 105 restores itself to an open circuit position. Initially, stronger spring constant K2 overcomes contact stiction to restore MEMS switch 100 to the position illustrated in FIG. 4A, at which point MEMS switch 100 is in deed open circuited (process block 335). Subsequently, a weaker restoring force proportional to the spring constant K1 returns MEMS switch 100 to the fully restored position illustrated in FIGS. 1A and 1B (process block 340).

However, if distal end 190 sticks in the bent position illustrated in FIG. 4A, MEMS switch 100 is still-open circuited since contact 120 is not touching bottom electrode 180. Therefore, even if stiction does prevent suspended electrode 105 from returning to its fully restored position, MEMS switch 100 will still continue to correctly function as a electromechanical switch. It should be noted that in an embodiment where suspended electrode 105 is fabricated of polysilicon, the relative hardness of polysilicon over traditional metal cantilevers lends itself to reduced incidence of stiction.

Due to the zipper-like action of MEMS switch 100, less wind resistance is generated by the cantilever of suspended electrode 105 while switching, when compared to the flapping motion generated by traditional electromechanical switches. Accordingly, MEMS switch 100 is well suited for high-speed switch applications, as well as, for low-speed applications. In one embodiment, the greater the actuation voltage the faster the zipper-like switch motion.

Figure 6A:
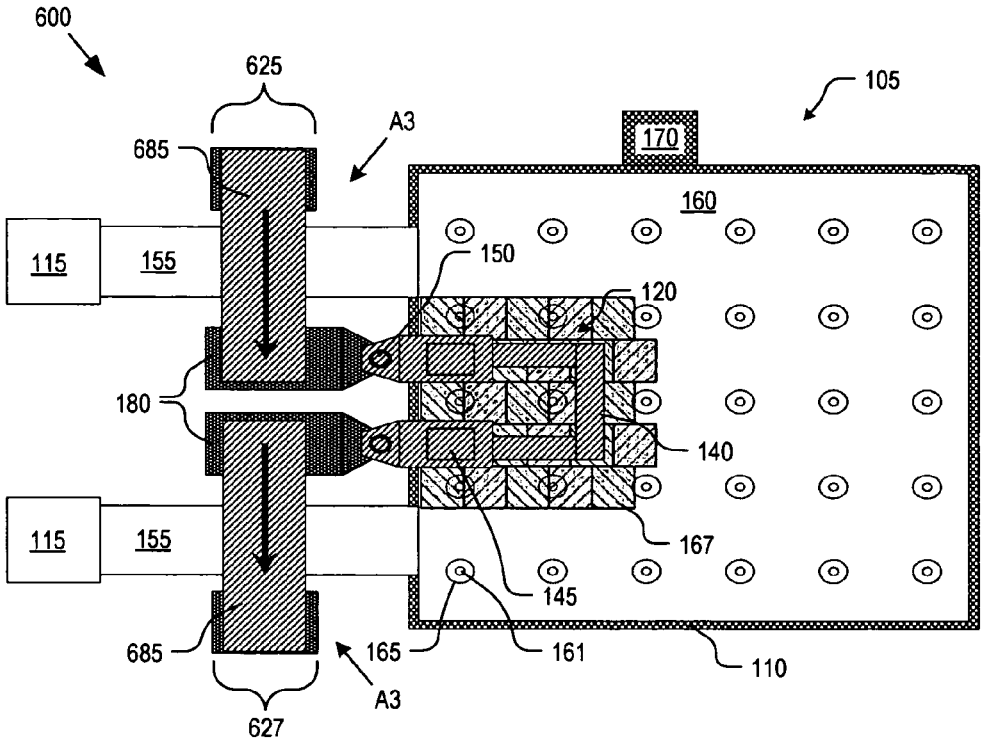
FIG. 6A is a schematic diagram illustrating a plan view of a switch including a suspended electrode having a rigidification topology localized about a contact and including an alternative RF trace design, in accordance with an embodiment of the invention.
Figure 6B:
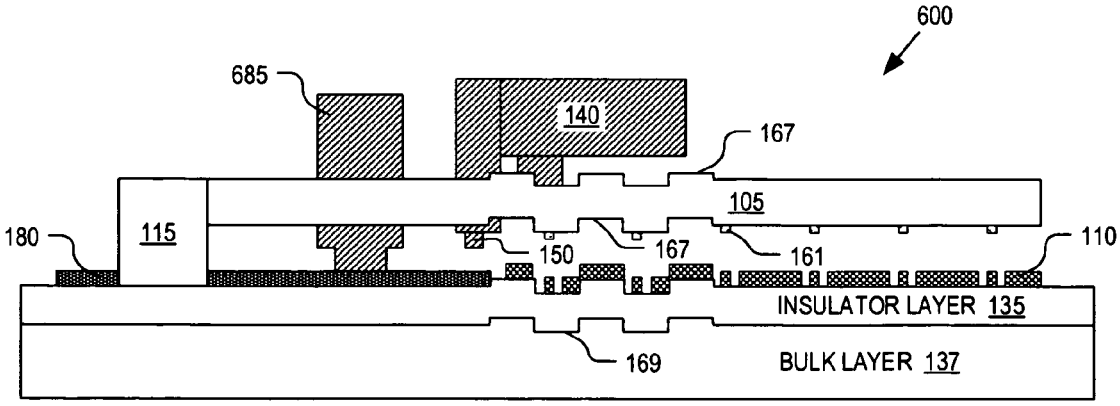
FIG. 6B is a schematic diagram illustrating a cross-sectional view of a switch including a suspended electrode having a rigidification topology localized about a contact and including an alternative RF trace design, in accordance with an embodiment of the invention.

FIGS. 6A and 6B are schematic diagrams illustrating a MEMS switch 600, in accordance with an embodiment of the invention. FIG. 6A is a plan view of MEMS switch 600 while FIG. 6B is a cross-sectional view of the same. MEMS switch 600 is similar to MEMS switch 100 with the exception that input signal line 625 and output signal line 627 are routed over narrow members 155 of suspended electrode 105. This rerouting of the RF paths avoids lengthy close proximity parallel runs of the RF paths (signal lines 625 and 627), which can cause parasitic inductances and capacitances between the RF traces themselves.

FIGS. 7A and 7B are plan views illustrating an example circuit layout of MEMS switch 600, in accordance with an embodiment of the invention. FIG. 7A illustrates a partially fabricated MEMS switch 600, while FIG. 7B illustrates a fully fabricated MEMS switch 600. FIG. 7A illustrates suspended electrode 105 without contact 120 disposed thereon to more fully demonstrate an example placement of rigidification structure 167. Again, it should be appreciated that the exact size, shape, orientation, and placement of the 3-dimensional rigidification topology may vary from one embodiment to the next.

Figure 8:
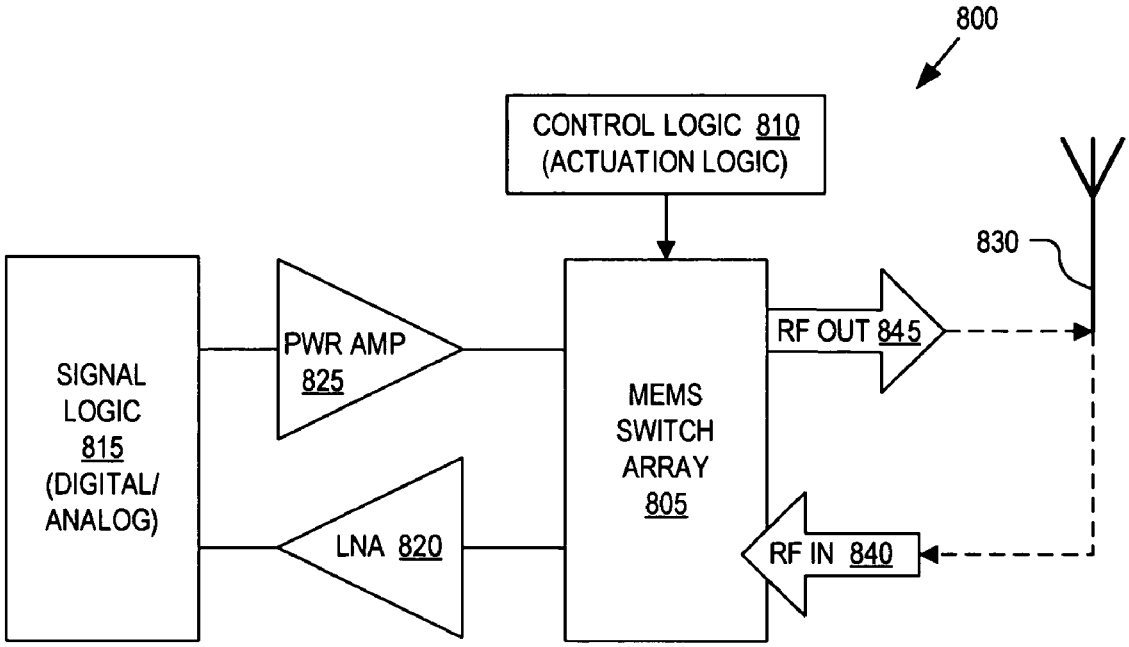
FIG. 8 is a functional block diagram illustrating a demonstrative wireless device implemented with a micro-electromechanical system switch array, in accordance with an embodiment of the invention.

FIG. 8 is a functional block diagram illustrating a demonstrative wireless device 800 implemented with a MEMS switch array, in accordance with an embodiment of the invention. Wireless device 800 may represent any wireless communication device including a wireless access point, a wireless computing device, a cell phone, a pager, a two-way radio, a radar system, and the like.

The illustrated embodiment of wireless device 800 includes a MEMS switch array 805, control logic 810, signal logic 815, a low noise amplifier ("LNA") 820, a power amplifier 825, and an antenna 830 (e.g., dipole antenna). MEMS switch array 805 may include one or more MEMS switches 100 or one or more MEMS switches 600. All or some of the components of wireless device 800 may or may not be integrated into a single semiconductor substrate (e.g., silicon substrate).

Control logic 810 may also be referred to as the actuation logic and is responsible for applying the actuation voltage for switching on/off the MEMS switches within MEMS switch array 805. Control logic 810 couples to actuation electrode 110 and/or suspended electrode 105 of each MEMS switch within MEMS switch array 805. Since the MEMS switches described herein are capable of ultra-low voltage actuation (e.g., <3.0V), control logic 810 may use logic level voltages (e.g., 3.3 V) to actuate MEMS switch array 805. In one embodiment, the same logic level voltage used by control logic 810 and/or signal logic 815 to switch transistors therein is also used to switch the MEMS switches of MEMS switch array 805.

During a receive operation, control logic 810 applies the actuation voltage to those MEMS switches coupled to RF input 840 such that an RF signal propagates through MEMS switch array 805 to LNA 820 from antenna 830. LNA 820 amplifies the RF signal and provides it to signal logic 815. Signal logic 815 may include analog-to-digital converters to convert the RF signal to a digital signal and further include logic elements to process the digital signal. During a transmit operation, control logic 810 applies the actuation voltage to those MEMS switches coupled to RF output 845 such that an RF signal propagates through MEMS switch array 805 to antenna 830 from power amplifier 825. Signal logic 815 may further include logic to generate a digital signal and a digital-to-analog converter to convert the digital signal to an RF signal.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A switch, comprising:

an actuation electrode disposed on a substrate;

a suspended electrode suspended proximate to the actuation electrode, the suspended electrode including a rigidification structure;

a contact mounted to the suspended electrode; and a signal line positioned proximate to the suspended electrode to form a closed circuit with the contact when an actuation voltage is applied between the actuation electrode and the suspended electrode, wherein the rigidification structure is localized about the contact to rigidify a portion of the suspended electrode less than the entire suspended electrode, wherein the rigidification structure comprises at least one of a checkerboard topology, an undulated topology, an elongated mesa structure, a plurality of bumps in the suspended electrode, a plurality of ridges in the suspended electrode, or a plurality of dimples in the suspended electrode.

2. The switch of claim 1, wherein the rigidification structure comprises a 3-dimensional rigidification topology localized about the contact.

3. The switch of claim 2, wherein the 3-dimensional rigidification topology is also disposed in the substrate and the actuation electrode.

4. The switch of claim 1, wherein the suspended electrode comprises a cantilever electrode including a fixed end and a distal end, wherein the cantilever electrode is configured to progressively bend toward the actuation electrode, when the actuation voltage is applied, starting from the distal end and moving toward the fixed end.

5. The switch of claim 4, wherein the contact protrudes below the cantilever electrode between the fixed end and the distal end of the cantilever electrode, and wherein the cantilever electrode includes multiple spring constants, a first of the multiple spring constants to provide a first restoring force to open circuit the signal line with the contact when the actuation voltage is removed and a second of the multiple spring constants to provide a second restoring force smaller than the first restoring force to separate the distal end of the cantilever electrode from the actuation electrode after the actuation voltage is removed.

6. The switch of claim 4, further comprising anchors to support the fixed end of the cantilever electrode, and wherein the cantilever electrode comprises:

a plate member; and two narrow members coupled to the plate member at first ends and mounted to the anchors at opposite ends.

7. The switch of claim 1, wherein the suspended electrode comprises polysilicon material.

8. A method of operating a switch, comprising:

propagating a signal along a signal line;

applying an actuation voltage, between an actuation electrode and a suspended electrode suspended proximate to the actuation electrode, to progressively bend the suspended electrode toward the actuation electrode;

close circuiting the signal line with a contact mounted to the suspended electrode proximate to a rigidification structure disposed in a portion of the suspended electrode; and propagating the signal between the signal line and the contact, wherein the rigidification structure comprises a 3-dimensional rigidification topology disposed in the portion of suspended electrode localized about the contact, wherein the actuation voltage is applied between the actuation electrode and the suspended electrode with alternating polarity between instances of close circuiting the signal line with the contact.

9. The method of claim 8, wherein the 3-dimensional rigidification topology comprises at least one of a plurality of dimples in the suspended electrode, a plurality of bumps in the suspended electrode, or a plurality of ridges in the suspended electrode.

10. The method of claim 8, wherein the suspended electrode comprises polysilicon and wherein the actuation voltage comprises a digital logic level voltage.

11. A system, comprising:

an amplifier;

an antenna; and an electromechanical switch coupled in series with the amplifier and the antenna, the electromechanical switch including:

an actuation electrode disposed on a substrate;

a suspended electrode suspended proximate to the actuation electrode, the suspended electrode including a rigidification structure;

a contact mounted to the suspended electrode; and a signal line positioned proximate to the suspended electrode to form a closed circuit with the contact when an actuation voltage is applied between the actuation electrode and the suspended electrode, wherein the rigidification structure comprises a 3-dimensional rigidification topology localized about the contact, wherein the 3-dimensional rigidification topology is also disposed in the actuation electrode.

12. The system of claim 11, wherein the 3-dimensional rigidification topology comprises an undulated topology.

13. The system of claim 11, further comprising control logic coupled to generate the actuation voltage, wherein the control logic is configured to generate the actuation voltage having a logic level voltage used by logic elements of the control logic.

14. A switch, comprising:

an actuation electrode disposed on a substrate;

a suspended electrode suspended proximate to the actuation electrode, the suspended electrode including a rigidification structure;

a contact mounted to the suspended electrode; and a signal line positioned proximate to the suspended electrode to form a closed circuit with the contact when an actuation voltage is applied between the actuation electrode and the suspended electrode, wherein the rigidification structure comprises a 3-dimensional rigidification topology disposed in the suspended electrode, wherein the 3-dimensional rigidification topology is also disposed in the actuation electrode.

* * * * *